United States Patent [19]

Sato

[11] 4,201,133

[45] May 6, 1980

[54] PRINTING PRESSURE DAMPING MECHANISM FOR HAND LABELER

[75] Inventor: Yo Sato, Tokyo, Japan

[73] Assignee: Kabushiki Kaisha Sato Kenkyusho, Tokyo, Japan

[21] Appl. No.: 893,332

[22] Filed: Apr. 4, 1978

[30] Foreign Application Priority Data

Apr. 12, 1977 [JP] Japan ..... 52/44806[U]

[51] Int. Cl.[2] ..... B41J 5/00

[52] U.S. Cl. ..... 101/288; 156/384; 400/649; 400/652; 400/686; 400/166; 400/167; 400/457; 101/93.02; 101/93.03; 101/292; 101/297

[58] Field of Search ..... 156/384; 400/648, 649, 400/397, 424, 652, 686, 687, 388, 157, 3, 388.1, 389, 166, 167, 457, 428, 435, 437, 440.2; 101/288, 292, 291, 316, 93.02, 10, 93.03, 20, 287, 297, 298; 267/158; 227/132; 74/97, 2; 173/118, 120, 139; 251/75–78, 80, 251, 262, 263

[56] References Cited

U.S. PATENT DOCUMENTS

| | | | |
|---|---|---|---|
| Re. 16,977 | 5/1928 | Anthony | 400/56 |
| 2,015,994 | 10/1935 | Eaton | 101/297 |
| 3,619,324 | 11/1971 | Sato et al. | 156/384 |
| 3,693,473 | 9/1972 | Beachner | 101/297 |
| 3,911,817 | 10/1975 | Becker | 101/288 |
| 3,912,068 | 10/1975 | Kwan et al. | 400/56 |
| 3,999,271 | 12/1976 | Pawloski | 173/120 |
| 4,024,816 | 5/1977 | Williams | 101/426 |
| 4,058,055 | 11/1977 | Douglas | 101/10 |

*Primary Examiner*—William Pieprz

*Attorney, Agent, or Firm*—Ostrolenk, Faber, Gerb & Soffen

[57] ABSTRACT

A printing pressure damping mechanism for use with a hand labeler: a hand lever is pivotally connected to the frame of the hand labeler. A printing head is carried by the hand lever so that it may move toward a printing platen when the hand lever is squeezed. An auxiliary lever is spaced from the hand lever and is movable to and from the hand lever. A shock absorbing coil spring is interposed under compression between the hand lever and the auxiliary lever so as to bias the levers apart. The auxiliary lever further moves against the biasing force of the coil spring when the printing head abuts the platen, so that the squeezing force which might otherwise be applied as a printing force by the printing head to the platen can be damped to a preset lever through the spring biased cooperation of the two levers. The platen is also spring biased to damp printing pressure.

11 Claims, 10 Drawing Figures

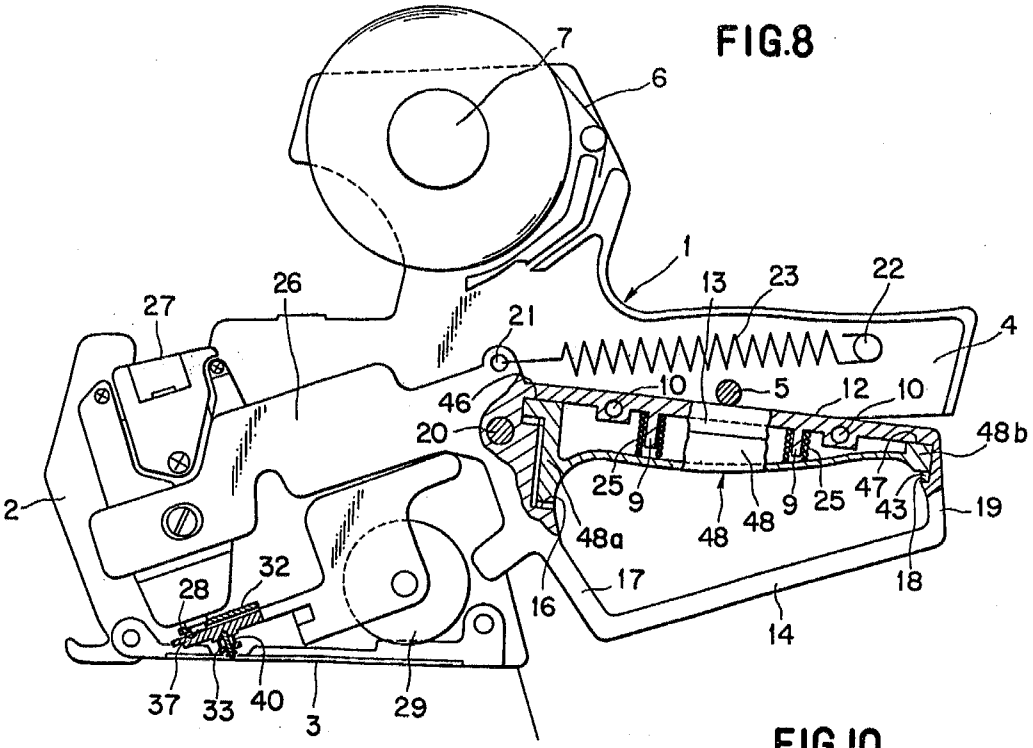
FIG.8
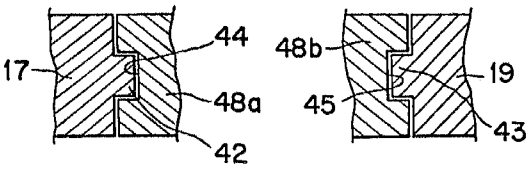
FIG.9
FIG.10

PRINTING PRESSURE DAMPING MECHANISM FOR HAND LABELER

BACKGROUND OF THE INVENTION

1. Field of the Invention

The present invention relates to a label printing and applying device, principally of the portable type (hereinafter referred to as a "hand labeler"), and more particularly to a printing pressure damping mechanism for use with the hand labeler. The squeezing force applied to the hand lever is damped to a preset level to maintain the printing pressure exerted by the printing head at a constant predetermined level.

2. Description of the Prior Art

When the hand lever of a hand labeler is squeezed, the printing head is moved into abutment with the platen so that labels fed to the platen are printed with desired indicia. In a conventional hand labeler, the squeezing force applied to the hand lever determines the printing pressure of the printing head against the platen.

When the hand lever is squeezed with a strong force, the resulting strong printing pressure on the platen is not damped by the hand lever. When the type surface of the printing head is made of a rigid material, such as metal, the type surface is vibrated, at a small amplitude, to and from the platen by the strong printing pressure causing double printing of the labels. On the other hand, when the type surface of the printing head is made of an elastic material, such as rubber, the printing on the platen under elevated pressure crushes the types causing the imprints on the labels to become unclear.

Moreover, the rebound of the impact of the printing head hitting the platen is transmitted to the hand of the user directly through the hand lever. As a result, the user feels uncomfortable and the squeezing operation cannot be carried out smoothly.

SUMMARY OF THE INVENTION

It is, therefore, an object of the present invention to damp the printing pressure of a hand labeler, or the like, for overcoming the drawbacks of conventional printing devices.

It is another object of the present invention to provide a printing pressure damping mechanism of the above type, in which even a strong squeezing force on the hand lever is damped to a preset level.

It is a further object of the invention to enable the squeezing force to be applied as the printing pressure to the platen and to still ensure clear printing operation of the labels under a constant printing pressure at all times.

It is yet another object of the invention to damp the impact of rebound that is transmitted to the hand lever during the printing operation to eliminate user discomfort and to smooth the squeezing of the hand lever.

The present invention relates to a printing pressure damping mechanism for use with a hand labeler which is operative to print a label and to apply the printed label to a commodity. The damping mechanism has the following features. A printing platen is mounted on the frame of the hand labeler. An operating lever, hereinafter specifically shown and described as a hand lever, is movably, and preferably pivotally, mounted on the frame of the hand labeler for pivotal movement between a released position and a squeezed position. A return spring biases the hand lever toward the released position. A printing head is carried by the hand lever and is movable between an inoperative position apart from the printing platen, when the hand lever is at the released position and a printing position against the printing platen when the hand lever is at the squeezed position. Shock absorbing means are engaged by the user's hand and these are squeezed and damp the squeezing force, and then the damped squeezing force is applied to the hand lever.

In the preferred embodiments, there is an auxiliary lever that has at least one part thereof, at least one end, for instance, that is spaced from the hand lever for movement relative thereto. Shock-absorbing means are mounted between the hand lever and the auxiliary lever and they bias the levers apart so that the auxiliary lever may be further moved against the biasing force. As a result, the squeezing force, which might otherwise be applied as a printing pressure to the printing platen, is damped to a preset level through the cooperation between the two levers.

BRIEF DESCRIPTION OF THE DRAWINGS

Other objects and features of the present invention will become apparent from the following description read in conjunction with the accompanying drawings, in which:

FIG. 8 is a view similar to FIG. 7 showing the hand labeler in the condition in which the hand lever is squeezed to its full stroke for printing;

FIG. 9 is an enlarged cross-sectional view along the line IX—IX of FIG. 7; and

FIG. 10 is an enlarged cross-sectional view taken along the line X—X of FIG. 7.

DESCRIPTION OF THE PREFERRED EMBODIMENTS

Figure 1:
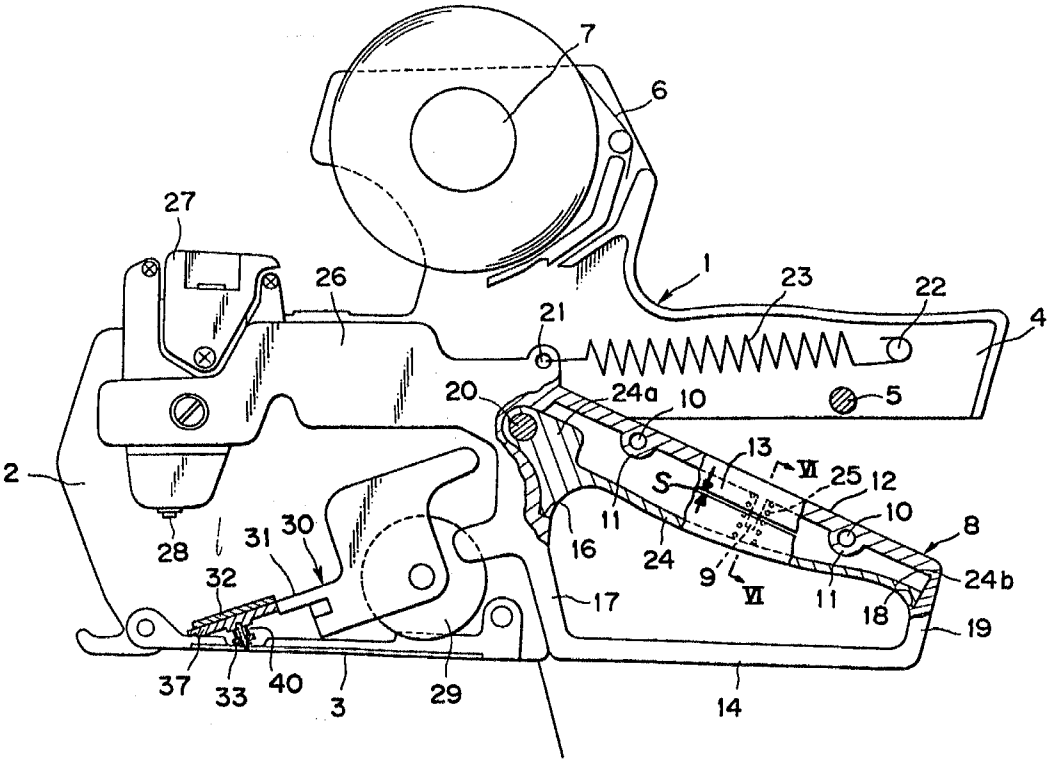
FIG. 1 is a partially cut-away, side elevational view showing a hand labeler, which is equipped with a first embodiment of a printing pressure damping mechanism according to the present invention, wherein the hand lever is released, and the side plate of the hand labeler on the viewing side is removed for illustrative purposes.

A first embodiment of the present invention is now described with reference to FIGS. 1-6. The hand labeler has a body 1 comprised of a pair of parallel side plates 2, which are spaced apart, and a bottom plate 3, which is pivotally connected to the lower end portions of the side plates 2. The side plates 2 are formed at their upper rear (or right, as viewed from FIG. 1) portions into an integral grip 4. A stopper 5 is mounted to the inside walls of the grip 4 and is positioned to block the rotational motion of a later described operating or hand lever 8 beyond a preset rotational angle.

A continuous label strip 6, which is comprised of a strip of backing paper and a number of labels removably adhered in a continuous series to the backing paper, is fed through the labeler and imprinted therein. A label holder 7 is disposed at the upper middle portion of the body 1 of the hand labeler and the continuous label strip 6 is wound on the holder 7.

There is an operating or hand lever 8, which, in side view, is generally trapezoidal in shape, and which is positioned below the grip 4 of the body 1. The hand lever 8 is comprised of an upper wall 12, a pair of opposed, depending side walls 13, a lower arm portion 14, a first, front connecting portion 17 and a second, rear connecting portion 19. The upper surface of the upper wall 12 is abuttable against the stopper 5 in the grip 4 and the lower surface of the wall 12 has a spring retaining pin 9, which projects from the center portion thereof. Both in front of and to the rear of the spring retaining pin 9, the lower surface of the upper wall 12 supports a pair of projecting portions 11, each of which is formed with a transversely extending threaded hole 10. The side walls 13 of the hand lever 8 are fixed to both sides of the upper wall 12 by screws 15 extending into the threaded holes 10 of the projecting portions 11 (see FIG. 6). The lower arm 14 is spaced away from and below the upper wall 12. The first front connecting portion 17, which connects the front end portions of the upper wall 12 and the lower arm 14, is formed with an engagement recess 16 that is substantially at the center portion of its inner periphery. The second connecting portion 19 is arranged at the opposed position to the first connecting portion 17 to connect the rear end portions of the upper wall 12 and the lower arm 14. The second portion 19 also has an engagement recess 18 that is substantially at the center portion of its inner periphery. The connected end portions of the upper wall 12 and the first connecting portion 17 are mounted pivotally on a pivot pin 20 which is mounted to the two side plates 2 of the frame. Thus, the hand lever 8 can be squeezed toward the grip 4 from its released position.

There is a return tension spring between a spring hole 21, which is formed in the hand lever 8, and a spring pin 22, which is anchored at the rear end portion of the grip 4. This biases the hand lever 8 in the clockwise direction, as viewed in FIG. 1, due to the tensile action of the return spring 23.

Below the side walls 13 of the hand lever 8 there is an auxiliary lever 24, which has a generally U-shaped cross-section in end elevation. The upper open end of the lever 24 faces the upper wall 12 of the hand lever 8. The auxiliary lever 24 has a front end portion 24*a* that is pivotally supported on the pivot pin 20 and that separably engages the engagement recess 16 of the first connecting portion 17. The rear end portion 24*b* of the auxiliary lever 24 separably engages the engagement recess 18 of the second connecting portion 19. Between the inner bottom of the U of the auxiliary lever 24 and the lower surface of the upper wall 12 of the hand lever 8 there is interposed at their center portions a shock-absorbing compression coil spring 25, which is mounted around the spring retaining pin 9. The elastic force of the coil spring 25 always biases the auxiliary lever 24 clockwise, i.e. apart from the upper wall 12 of the hand lever 8 and into the recesses 16 and 18 as shown in FIG. 1. When the auxiliary lever 24 is in this remote position from the lever 8, a preset spacing S is established between the upper open ends of the auxiliary lever 24 and the opposed lower ends of the side walls 13 of the hand lever 8.

A bifurcated yoke 26 extends integrally forward from the upper end of the first connecting portion 17 of the hand lever 8. A printing head 27 is mounted between the separate front end portions of the yoke 26. The lower end of the head 27 is equipped with a type surface 28.

There is a label advancing means of a conventional type which includes a label feed roller 29 that is located below the rear end portion of the yoke 26. Rotation of the label feed roller 29 is made responsive to the squeezing and releasing operations of the hand lever 8. The continuous label strip 6 may be unrolled from the label holder 7 and fed intermittently, one label at a time, onto a below described printing platen 30. The platen 30 has a flat surface 31 at its front (or left, as viewed in FIG. 1) end portion and is arranged in a preset position with respect to the body 1 at a preset angle of inclination with respect to the side plates 2 of the body 1.

The opposed faces of the plates 2 each carry one of a pair of upper platen stoppers 32, which extend toward each other and carry one of a pair of lower platen stoppers 33, which are spaced below and are opposed to the lower surfaces of the upper stoppers 32.

The upper stoppers 32 have a generally rectangular flat shape. They extend forwardly (i.e., to the right and left in FIG. 1) along both side plates 2. They are inclined such that their front (left in FIG. 1) ends are positioned slightly lower than their rear ends.

Figure 3:
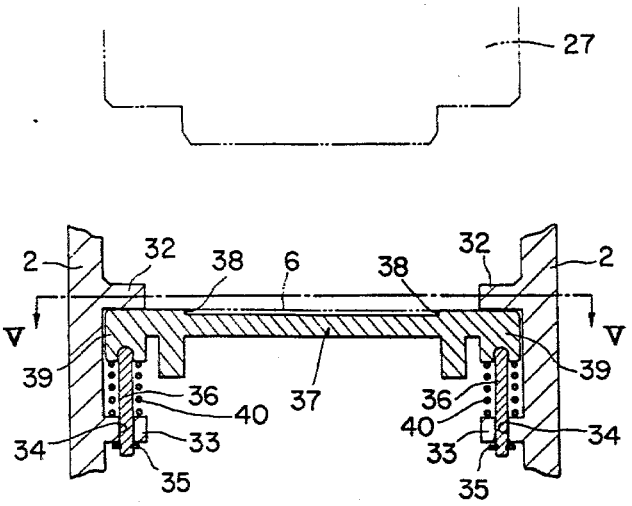
FIG. 3 is a transverse cross-sectional view showing the portion of the hand labeler in the vicinity of the printing platen when printing is not occurring.
Figure 4:
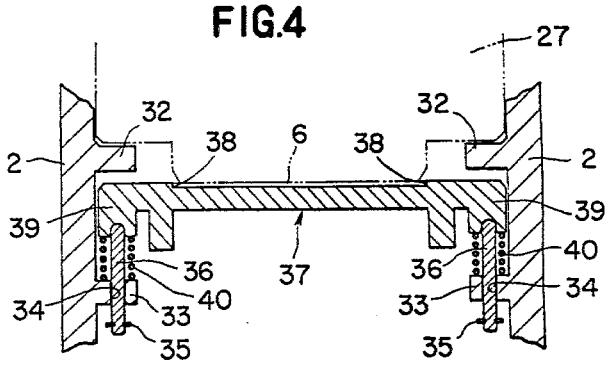
FIG. 4 is a view similar to FIG. 3 showing the same portion of the labeler when printing is occurring.
Figure 5:
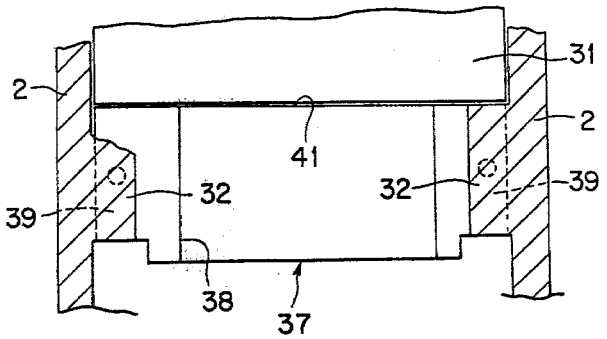
FIG. 5 is an enlarged cross-sectional view along the line V—V of FIG. 3.
Figure 6:
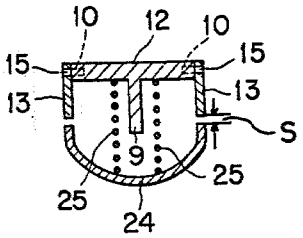
FIG. 6 is an enlarged cross-sectional view along the line VI—VI of FIG. 1.

The lower stoppers 33 have through holes 34, which extend vertically through their center portions. A respective, vertically extending pin 36 is movably inserted into each through hole 34. Each pin 36 is formed with a retaining flange 35 at its lower end portion, as seen in FIGS. 3 and 4.

The body 37 of the platen 30 is adapted to receive printing pressure from the printing head 27. The continuous label strip 6 is fed through the guide groove 38 in the upper surface of the platen 37. The surface of the label strip 6 is printed with the indicia on the type surface 28. The platen body 37 is made of a metal material and is formed into a generally rectangular shape. The body 37 has side portions 39 which extend down therefrom and are arranged between the upper and lower stoppers 32 and 33 of the side plates 2 such that the body 37 can move slightly up and down. The upper ends of the aforementioned stopper pins 36 are anchored in the lower wall of both side portions 39, so that the pins 36 move together with the platen 37 and move with respect to the stoppers 33.

Shock-absorbing compression coil springs 40 are mounted around the anchor pins 36 and are interposed between the lower stoppers 33 of the side plates 2 and the lower faces of both side portions 39 of the platen body 37. The elastic forces of the coil springs 40 continuously bias the platen body 37 upward (i.e., towards the printing head 27), as viewed in FIGS. 3 and 4. In the normal non-printing or released condition of the hand lever 8, the upper ends of both side portions 39 of the platen body 37 abut against the lower faces of the upper stoppers 32, as seen in FIG. 3. In this instance, the platen body 37 has its rear end portion 41 facing the front end of the flat surface 31 of the platen 30 and has its upper surface positioned flush with the flat surface of the platen 30.

The operation of the first embodiment of the printing pressure damping mechanism according to the present invention is now described.

Normally, the hand lever 8 and its auxiliary lever 24 are held under their released or remote conditions, as seen in FIG. 1, and the printing head 27 is in an inoperative position apart from the platen body 37. The platen body 37 is held at its upper limit position, shown in FIG. 3, by the force of the coil springs 40.

When the hand lever 8 is squeezed by squeezing the auxiliary lever 24 toward the grip 4 against the biasing forces of the return spring 23 and the coil spring 25, the hand lever 8 is turned counterclockwise, as viewed in FIG. 1, about the pivot pin 20, and the yoke 26 and the printing head 27 are accordingly also turned counterclockwise. The auxiliary lever 24 has also been slightly further turned counterclockwise, i.e. toward the upper wall 12 of the hand lever 8, as viewed in FIG. 1, about its pivot pin 20.

When the two levers 8 and 24 have been turned through preset angles, the type surface 28 of the printing head 27 is first brought into abutment contact against the continuous label strip 6 in the guide groove 38 and against the upper surface of the platen body 37.

When the two levers 8 and 24 are squeezed further, the hand lever 8 is further turned counterclockwise about the pivot pin 20 against the biasing force of the return spring 23, while the auxiliary lever 24 is also turned in the same direction about the same pin 20 against the biasing force of the coil spring 25.

This also turns the printing head 27 slightly counterclockwise. Accordingly, the platen body 37 is lowered from the upper stoppers 32 to the lower stoppers 33 of both side plates 2, against the upward biasing force of the coil spring 40, while the platen body maintains its contact with the type surface 28 of the printing head 27. Meanwhile, the printing pressure between the type surface 28 of the printing head 27 and the platen body 37 is maintained at a constant level by the shock-absorbing actions of the coil springs 40. Furthermore, the squeezing force applied to the two levers 8 and 24 is damped to a preset level by the shock-absorbing action of the coil spring 25 so that the preset level of the squeezing force can be applied as the printing pressure to the platen body 37.

Further counterclockwise turning of the hand lever 8 is blocked when the upper surface of the hand lever upper wall 12 abuts against the stopper 5 in the grip 4. At the same time, further turning of the printing head 27 is also blocked so that the printing pressure between the type surface 28 and the platen body 37 is maintained at the established constant level.

Figure 2:
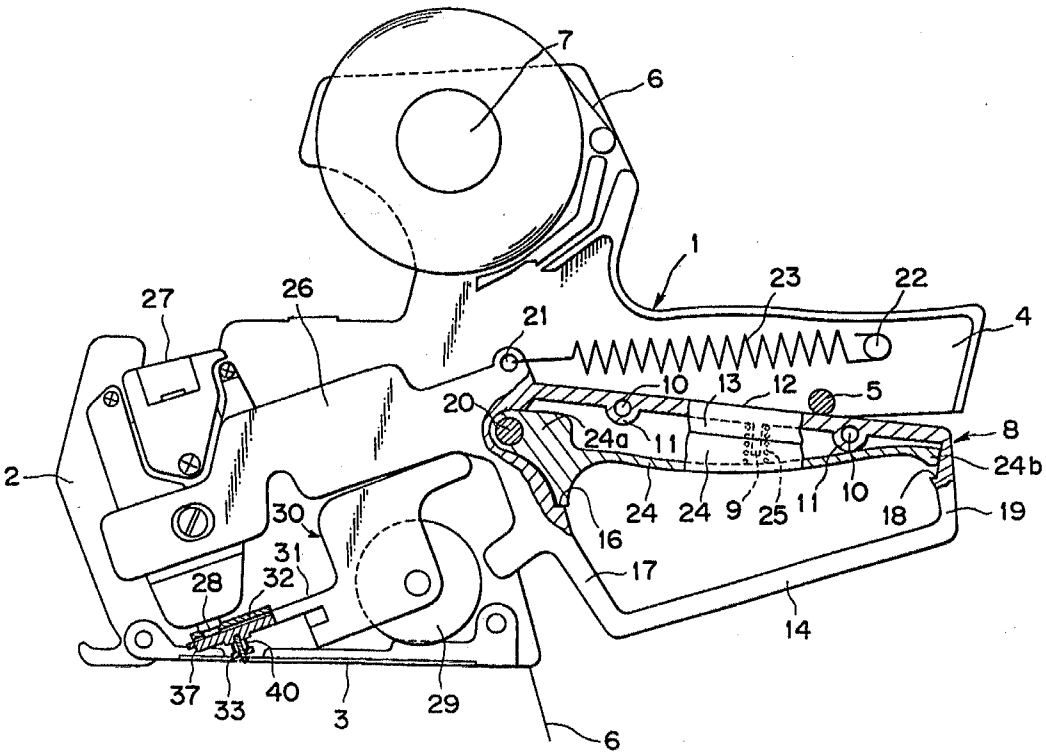
FIG. 2 is a view similar to FIG. 1 showing the hand labeler in the condition in which the hand lever is squeezed to its full stroke for printing.

When the two levers 8 and 24 are now squeezed further, only the auxiliary lever 24 is allowed to rotate counterclockwise, as viewed in FIG. 2, about the pivot pin 20 against the biasing force of the coil spring 25 until rotation of lever 24 is blocked when its rearward end portion is brought into abutment against the projecting portion 11 of the upper wall 12 of the hand lever 8. At this instant, the open upper ends of the auxiliary lever 24 are also in abutment engagement with the lower ends of the side walls 13 of the hand lever 8, as better seen in FIG. 2.

When the two levers 8 and 24 are released, the auxiliary lever 24 is turned clockwise about the pivot pin 20 by the biasing force of the coil spring 25 with respect to the lever 8 until both end portions **24*a* and 24*b* of the lever 24 are brought into abutment engagement with the engagement recesses 16 and 18 of the first and second connecting portions 17 and 19, respectively, of the hand lever. Meanwhile, the hand lever 8 is also turned clockwise by the biasing force of the return spring 23 so that the printing head 27 is moved upward, as viewed in FIG. 2. As a result, the platen body 37 is also moved upward, as viewed in FIG. 4, while being held in pressure contact with the type surface 28 of the printing head 27. Continued upward movement of the platen body is blocked when the side portions 39 of the platen body 37 are brought into abutment engagement with the upper stoppers 32**.

When the hand lever 8 is further released to rotate clockwise from the above specified position, the type surface 28 of the printing head 27 leaves the platen body 37 and rises until it is restored to its initial position, shown in FIG. 1.

The above described printing pressure damping mechanism can, even in case a strong squeezing force is applied to the hand lever 8 through the auxiliary lever 24, prevent the squeezing force from being imparted as a printing pressure directly to the platen body 37. That strong squeezing force is first weakened to a preset squeezing force by the shock-absorbing action of the coil spring interposed between the hand lever 8 and the auxiliary lever 24. The once weakened squeezing force is further weakened to a desired printing pressure by the shock-absorbing action of the coil spring 40 before the force is applied as a printing pressure to the platen body 37. In this way, the squeezing force applied to the hand lever 8 is weakened twice to reliably obtain a constant printing pressure, thus ensuring the desired clear printing of labels without any difference in shading.

A second embodiment of the present invention is described with reference to FIGS. 7–10. Elements corresponding to those of the first embodiment are designated by the same reference characters, and further explanations thereof are omitted.

The second embodiment differs from the first embodiment with respect to the auxiliary lever and its relationship to the hand lever. The auxiliary lever 48 is in the same position as the hand lever 24. The lever 48 is non-pivotally movable relative to the hand lever 8. A plurality, two being illustrated, of shock-absorbing coil springs 25 are interposed between the upper wall 12 of the hand lever 8 and the auxiliary lever 48.

More specifically, the forward first and rearward second connecting portions 17 and 19 of the hand lever 8 have their facing inner walls formed with fitting lands 42 and 43, which are slidably fitted in fitting grooves 44 and 45 that are formed in the two end portions **48*a* and 48*b* of the auxiliary lever 48, respectively, as better seen in FIGS. 9 and 10. These connections guide the motion of the auxiliary lever 48 over a preset distance to and from the underside of the upper wall 12 of the hand lever 8**.

The upper surfaces of both end portions **48*a* and 48*b* of the auxiliary lever 48 define respective abutment surfaces 46 and 47, which can abut against the lower faces of the upper wall 12 of the hand lever 8 so as to regulate and position the movement of the auxiliary lever 48 in the direction toward the upper wall 12**.

Figure 7:
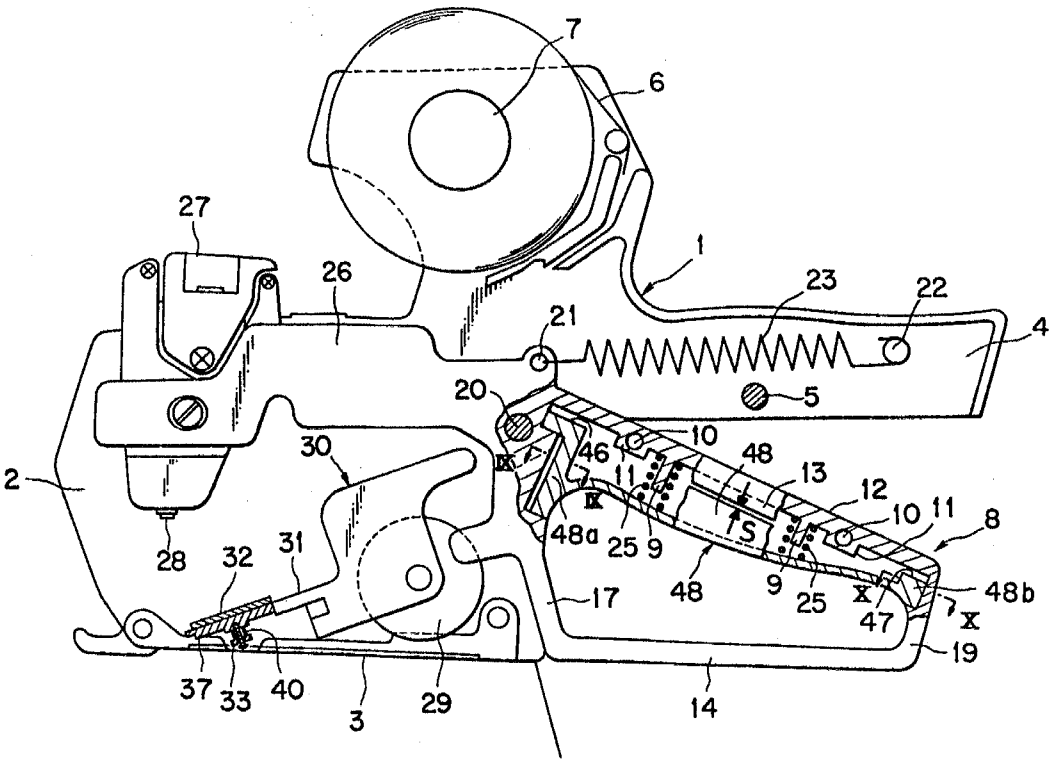
FIG. 7 is a partially cut-away side elevational view of a hand labeler, which is equipped with a second embodiment of a printing pressure damping mechanism according to the present invention, wherein the hand lever is released and the side plate of the hand labeler on the viewing side is removed for the illustrative purposes.

The paired coil springs 25 are interposed at a preset spacing apart and are positioned between the lower face of the upper wall 12 of the hand lever 8 and the inner bottom face of the auxiliary lever 48. The coil springs 25 are mounted around the paired spring retaining pins 9 which integrally project from the lower face of the upper wall 12 of the hand lever 8. The springs 25 constantly bias the auxiliary lever 48 in the direction away from the upper wall 12 of the hand lever 8, as seen in FIG. 7.

The operation of the second embodiment is substantially similar to the operation of the first embodiment. The printing pressure damping mechanism of the second embodiment can damp the squeezing force more reliably, even when a strong squeezing force is applied to the hand labeler 8, because two coil springs 25 are used for the shock-absorbing purpose. Since the auxiliary lever 48 can move to and from the upper wall 12 along the fitting lands 42 and 43 of the hand lever 8, the squeezing operations of the hand lever 8 through the auxiliary lever 48 can be accomplished more smoothly.

Although in both of the foregoing embodiments, the coil spring 25 is interposed between the hand lever 8 and the auxiliary levers 24 and 48, the present invention is not limited to such a construction. Instead, an elastic member, of rubber or the like, can be used in place of the coil springs. Moreover, the auxiliary levers 24 and 48 can alternatively themselves be made of a flexible, resilient material, such as a synthetic resin or metal, and can be formed with integral and flexible tongues (not-shown), which have their extending ends abutting against the lower face of the upper wall 12 of the hand lever 8. In this event, the squeezing force that is to be applied to the hand lever 8 through the auxiliary levers 24 and 48 can be damped by the flexibility of the tongues. In short, any construction will suffice if the squeezing force is damped between the hand lever 8 and the auxiliary levers 24, 48, etc.

As described above, the printing pressure damping mechanism according to the present invention comprises an auxiliary lever that coacts with the hand lever, and the hand lever is actuatably attached to the body of a hand labeler. The connection between the hand lever and the auxiliary lever is elastic so as to damp the printing pressure of the printing head which is moved by the squeezing operation of the hand labeler.

The present invention has a number of advantages. Even if the hand lever and the auxiliary lever are squeezed by an especially strong force, this strong squeezing force can be damped by the action of the shock-absorbing means interposed between the two levers, and the resultant preset force can be applied as the printing force of the printing head against the platen so that clear imprints on the label surface can be obtained without any difference in shading.

Since the rebound of the impact when the printing head abuts against the platen can be elastically absorbed by the shock-absorbing means between the two levers, discomfort to the user of the hand labeler due to the direct transmission of the impact can be eliminated.

Since the auxiliary lever is elastically supported by the hand lever, the smooth cooperation between these can be assured in the squeezing operation. The overall construction of the damping mechanism is so simple that the assembly and manufacturing process can be accordingly simplified and the production cost can be reduced to a satisfactory extent.

Although the present invention has been described in connection with a number of preferred embodiments thereof, many variations and modifications will now become apparent to those skilled in the art. It is preferred, therefore, that the present invention be limited not by the specific disclosure herein, but only by the appended claims.

What is claimed is:

1. A printing pressure damping mechanism for use with an apparatus for imprinting a label, or the like, comprising:

a support frame a printing platen for supporting a label, or the like, to be imprinted; said platen being supported by said frame;

an operating lever movable between a released position and a squeezed position; said operating lever being supported by said frame for movement, with respect to said frame, between said inoperative and said printing positions;

a printing head attached to said operating lever and movable thereby between an inoperative position apart from said platen, when said operating lever is at said released position, and a printing position against said platen, when said operating lever is at said squeezed position;

an auxiliary lever having at least a portion thereof spaced from said operating lever and movable with respect to said operating lever; said auxiliary lever being so placed with respect to said operating lever such that motion of said auxiliary lever in one direction urges said operating lever to said squeezed position thereof;

first shock-absorbing means connecting said operating lever and said auxiliary lever and biasing said operating and said auxiliary levers apart; said auxiliary lever being biased away from said one direction thereof, whereby force on said operating lever, through said auxiliary lever, is damped and thereby damps the pressure on said platen that is exerted by said printing head moving to said printing position thereof;

second shock-absorbing means between said frame and said platen for biasing said platen toward said printing head and for absorbing impact of said printing head against said platen, thereby further damping printing pressure of said printing head; said second shock-absorbing means comprising a compression spring between said platen and said frame and compressible by motion of said platen under influence of said printing head at said printing position thereof.

2. The printing pressure damping mechanism of claim 1, further comprising return spring means normally biasing said operating lever to said released position thereof.

3. The printing pressure damping mechanism of claim 1, wherein said operating lever is pivotally supported to said frame for pivoting with respect thereto between its said positions.

4. The printing presure damping mechanism of either of claims 1 or 3, wherein said auxiliary lever is pivotally supported for pivoting with respect to said operating lever.

5. The printing pressure damping mechanism of claim 4, wherein said auxiliary lever is pivotally supported to said operating lever to move therewith and to pivot with respect thereto.

6. The printing pressure damping mechanism of claim 3, wherein said first shock-absorbing means comprises a compression spring between said operating lever and said auxiliary lever.

7. The printing pressure damping mechanism of either of claims 1 or 3, wherein said auxiliary lever is normally movable toward and away from said operating lever in a non-pivoting manner.

8. The printing pressure damping mechanism of claim 7, wherein said first shock-absorbing means comprises a compression spring between said operating lever and said auxiliary lever.

9. The printing pressure damping mechanism of claim 8, wherein said first shock-absorbing means comprises two compression springs located between said operating lever and said auxiliary lever; each said compression spring engaging each said lever at a location spaced from the engagement with that said lever by the other said compression spring.

10. The printing pressure damping mechanism of claim 1, further comprising means for blocking motion of said platen toward said printing head beyond a predetermined position of said platen; at said platen predetermined position, said printing head is at said printing position thereof when it engages said platen and said auxiliary lever has caused said shock-absorbing means to urge said operating lever to said squeezed position thereof.

11. The printing pressure damping mechanism of claim 10, wherein said means for blocking motion comprises an abutment supported by said frame and engageable by said platen.

* * * * *